US005231710A

United States Patent [19]

Markel et al.

[11] Patent Number: 5,231,710

[45] Date of Patent: Aug. 3, 1993

[54] CONVERTIBLE SOFA-BED

[75] Inventors: David Markel, Elkhart; David G. Sheely, Bristol, both of Ind.

[73] Assignee: Coachmen Industries, Inc., Elkhart, Ind.

[21] Appl. No.: 915,319

[22] Filed: Jul. 20, 1992

[51] Int. Cl.[5] ..... A47C 17/12

[52] U.S. Cl. ..... 5/21; 5/14; 297/107

[58] Field of Search ..... 5/21, 18.1, 17, 14, 5/22, 52; 297/107, 112, 118

[56] References Cited

U.S. PATENT DOCUMENTS

| | | | |
|---|---|---|---|
| 1,737,604 | 12/1929 | Martin | 5/21 |
| 2,069,258 | 2/1937 | Martin | 5/21 |
| 2,139,923 | 12/1938 | Woller | 5/18.1 |
| 2,712,655 | 7/1955 | Hatton | 5/21 |
| 2,744,266 | 5/1956 | Kaehn | 5/18.1 |
| 2,784,419 | 3/1957 | Cimon | 5/18.1 |
| 3,710,403 | 1/1976 | Weidner | 5/18.1 |
| 3,972,079 | 8/1976 | Shellow | 5/18.1 |
| 4,860,393 | 8/1989 | Schefthaler | 5/21 |

FOREIGN PATENT DOCUMENTS

| | | | |
|---|---|---|---|
| 805680 | 5/1951 | Fed. Rep. of Germany | 5/21 |

*Primary Examiner*—Peter M. Cuomo
*Assistant Examiner*—Flemming Saether
*Attorney, Agent, or Firm*—Thomas J. Dodd

[57] ABSTRACT

A convertible sofa-bed which includes a bed support frame which is shiftable with respect to the sofa frame to convert the sofa-bed between sofa and bed positions. The bed support frame is attached to one of the arm supports and is extended into a bed position by pulling on the sofa arm. The sofa-bed may also include a unique two-piece bed support frame connected by an over-center pivot linkage which locks the bed support frame into the bed position.

12 Claims, 6 Drawing Sheets

CONVERTIBLE SOFA-BED

FIELD OF THE INVENTION

This invention relates to sofa-beds and will have application to a convertible sofa-bed which is useful in limited spacers areas.

BACKGROUND OF THE INVENTION

Convertible sofa-beds are popular items which have found usefulness in many areas. They can be found in residential homes, recreational vehicles, hospitals, nursing homes, and in offices, just to name a few areas of use. The vast majority of these convertible sofa-beds include a pull-out bed support which extends from the front of the sofa-bed by use of a linkage mechanism.

In areas of limited available space, these sofa-beds may not be practical. Particularly in hospital rooms and some recreational vehicles, space is not readily available to allow the bed to be pulled out the front of the sofa-bed. Some sofas and also chairs are constructed with a slide-out bed section which slides out the front of the sofa or chair.

SUMMARY OF THE INVENTION

The convertible sofa-bed of this invention is designed to be useful in areas having extremely limited space. The sofa-bed includes a bed support frame which is slidably connected to one of the side located sofa arms. In the sofa position, the bed support is concealed within the sofa frame. To extend the bed support into a bed position, a user pulls outwardly on the arm to which the bed support is connected. The bed support then slides laterally with the arm into its extended bed position.

The bed support is preferably of a two-piece frame construction and may be covered by decorative fabric or the like. The upper frame and lower frame of the bed support are connected as by an over-center pivot link which both allows the upper frame to be raised to the same level as the seat support frame and also locks the bed support into the bed position.

Accordingly, it is an object of this invention to provide for a convertible sofa-bed which requires a minimal amount of space.

Another object is to provide for a sofa-bed which is easily converted between sofa and bed positions.

Another object is to provide for a sofa-bed which is durable, efficiently constructed, easy to maintain, and economical.

Another object is to provide for a pull sofa-bed which positively locks the bed extension into position.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
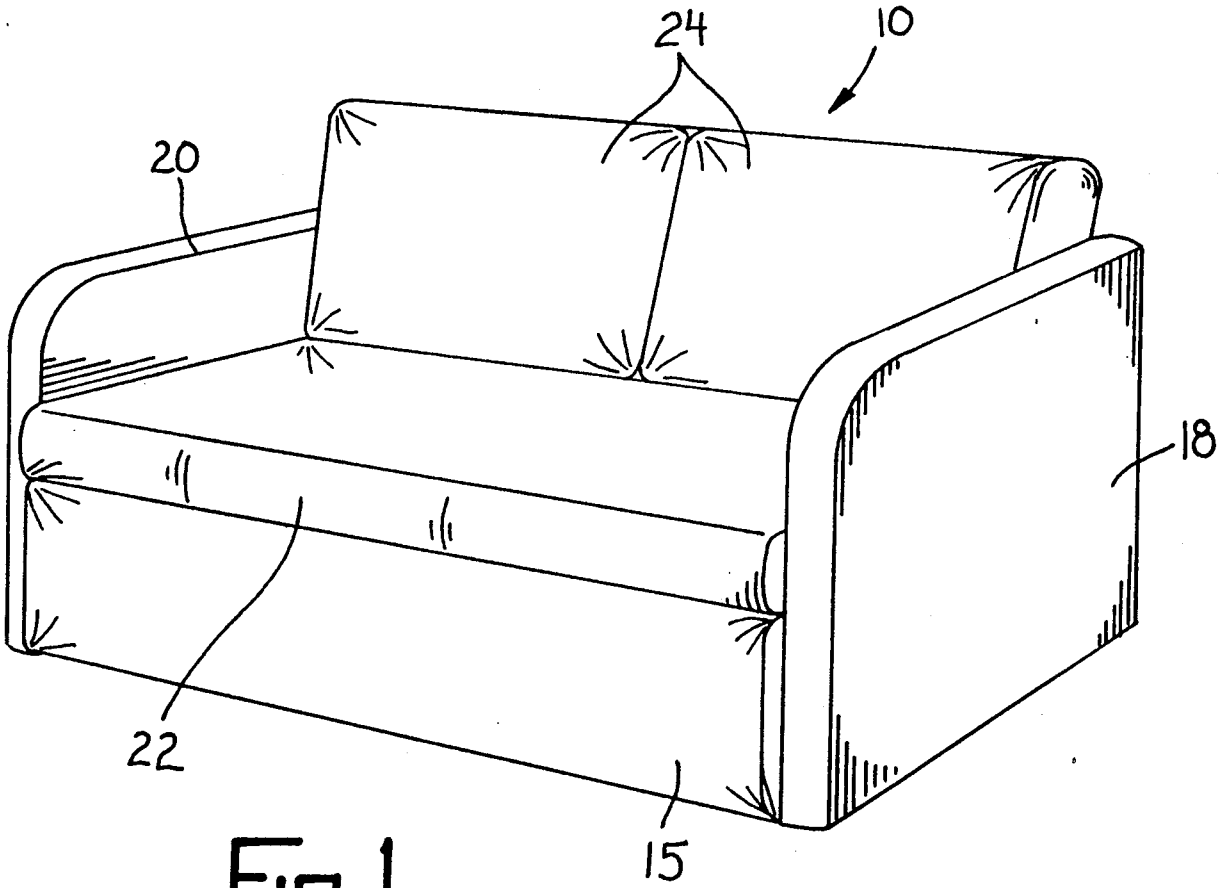
FIG. 1 is a perspective view of the sofa-bed of this invention shown in the sofa position.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings, reference numeral 10 generally designates the convertible sofa-bed of this invention. Sofa-bed 10 includes a frame support 12 defined by seat support part 14 front support 15, back support 16 and arms 18, 20. Seat cushion 22 and back cushions 24 are carried by support parts 14, 16, respectively. Arms 18, 20 and cushions 22, 24 are preferably covered by decorative fabric. Frame support 12 also includes lower rail supports 25.

Figure 2:
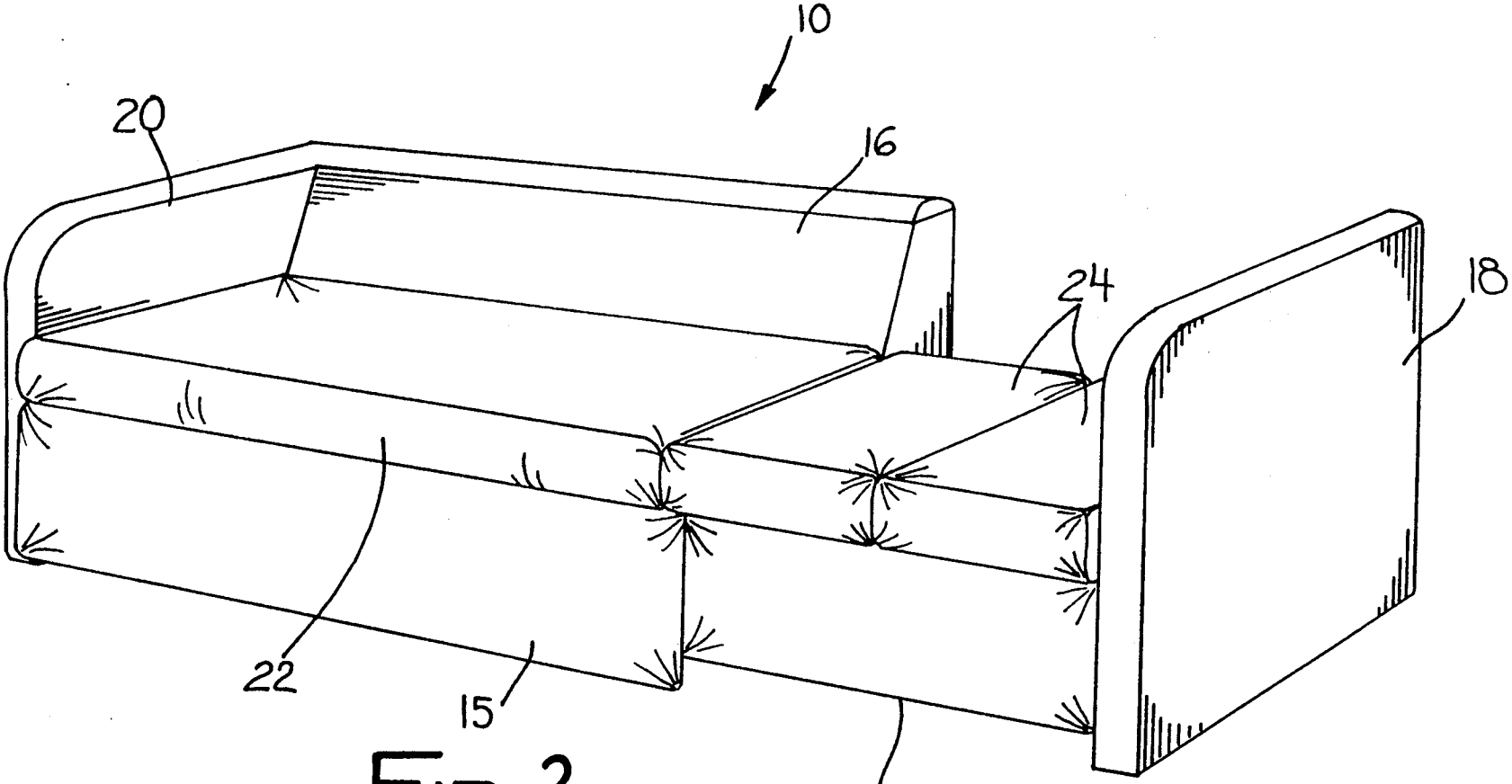
FIG. 2 is a perspective view of the sofa-bed in the bed position.
Figure 3:
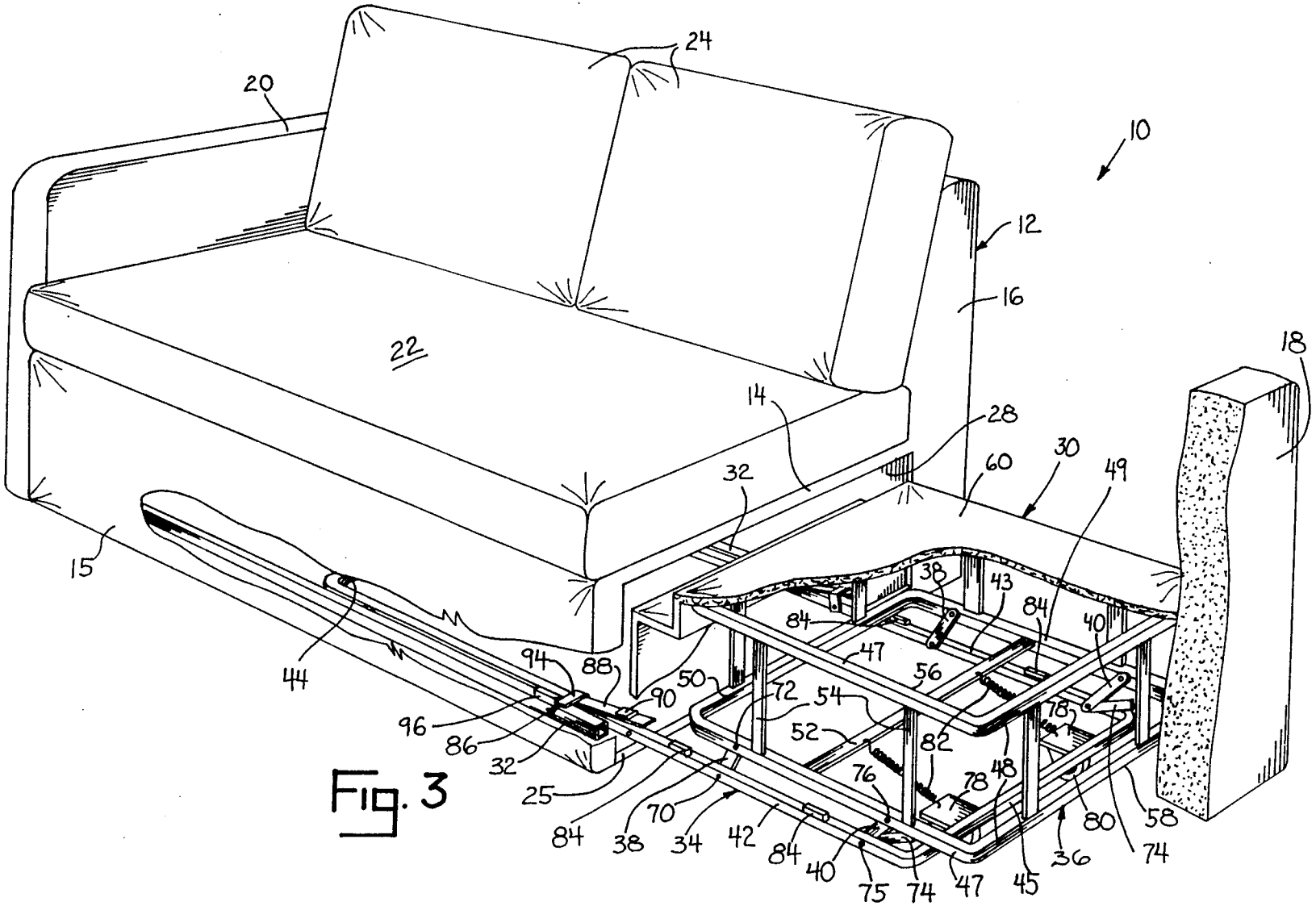
FIG. 3 is a perspective view of the sofa-bed in the bed position with portions cut away for illustrative purposes.
Figure 4:
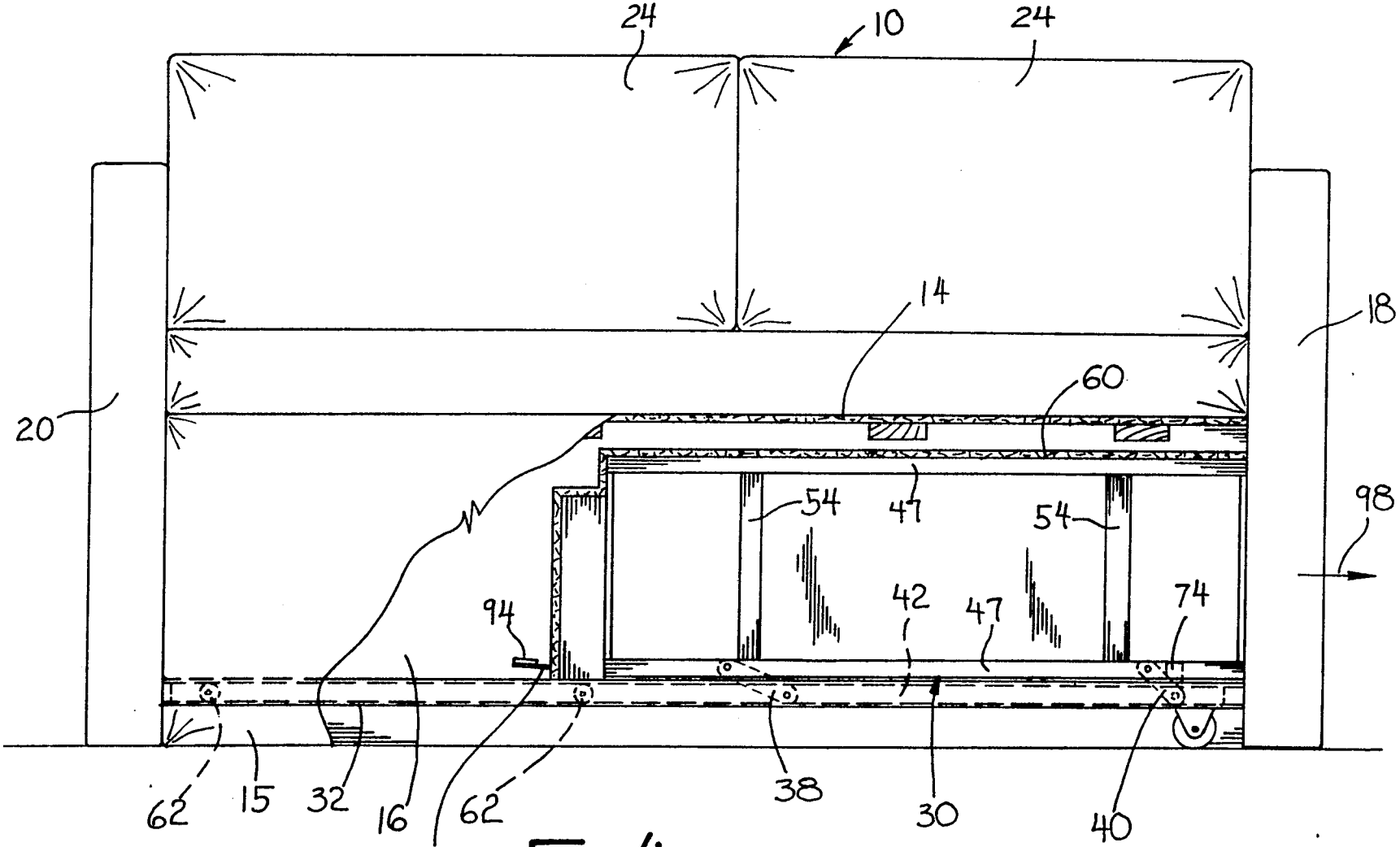
FIG. 4 is an elevational view of the sofa-bed with portions cut away for illustrative purposes.
Figure 5:
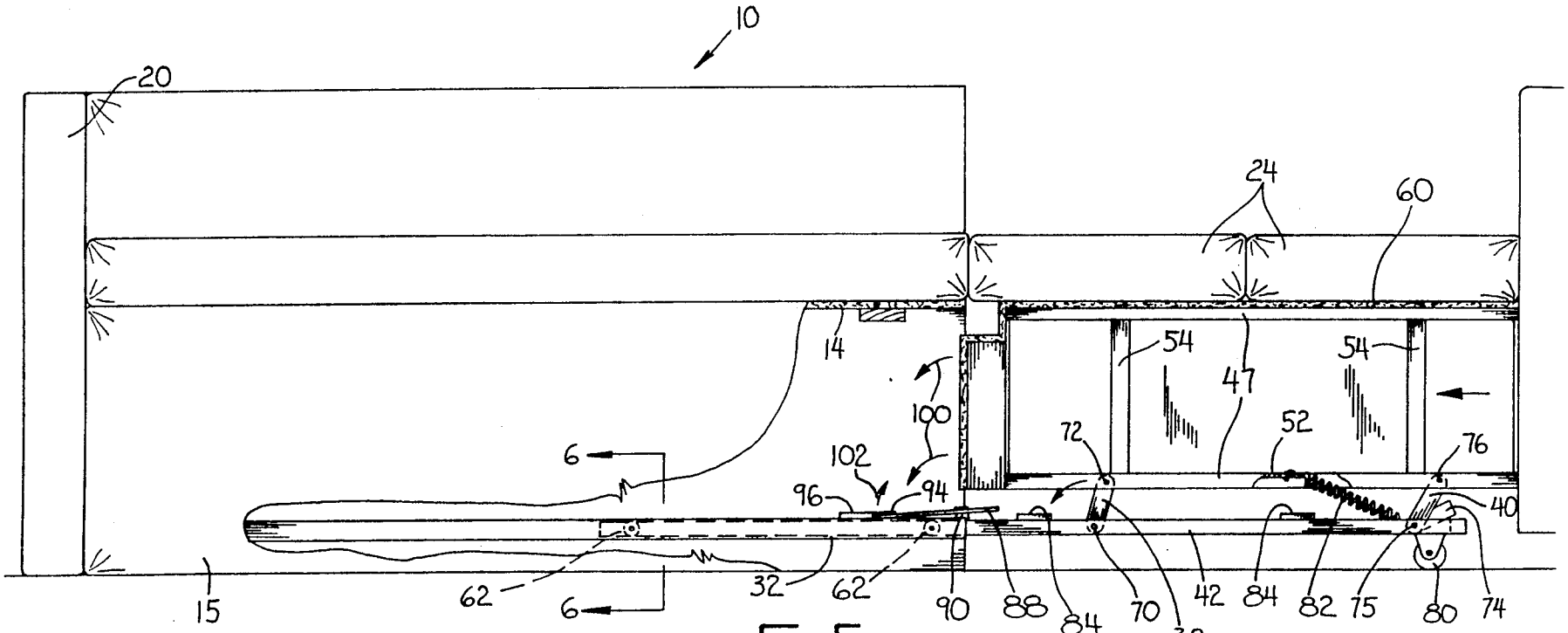
FIG. 5 is an elevation view of the sofa-bed of FIG. 4 in the bed position.
Figure 6:
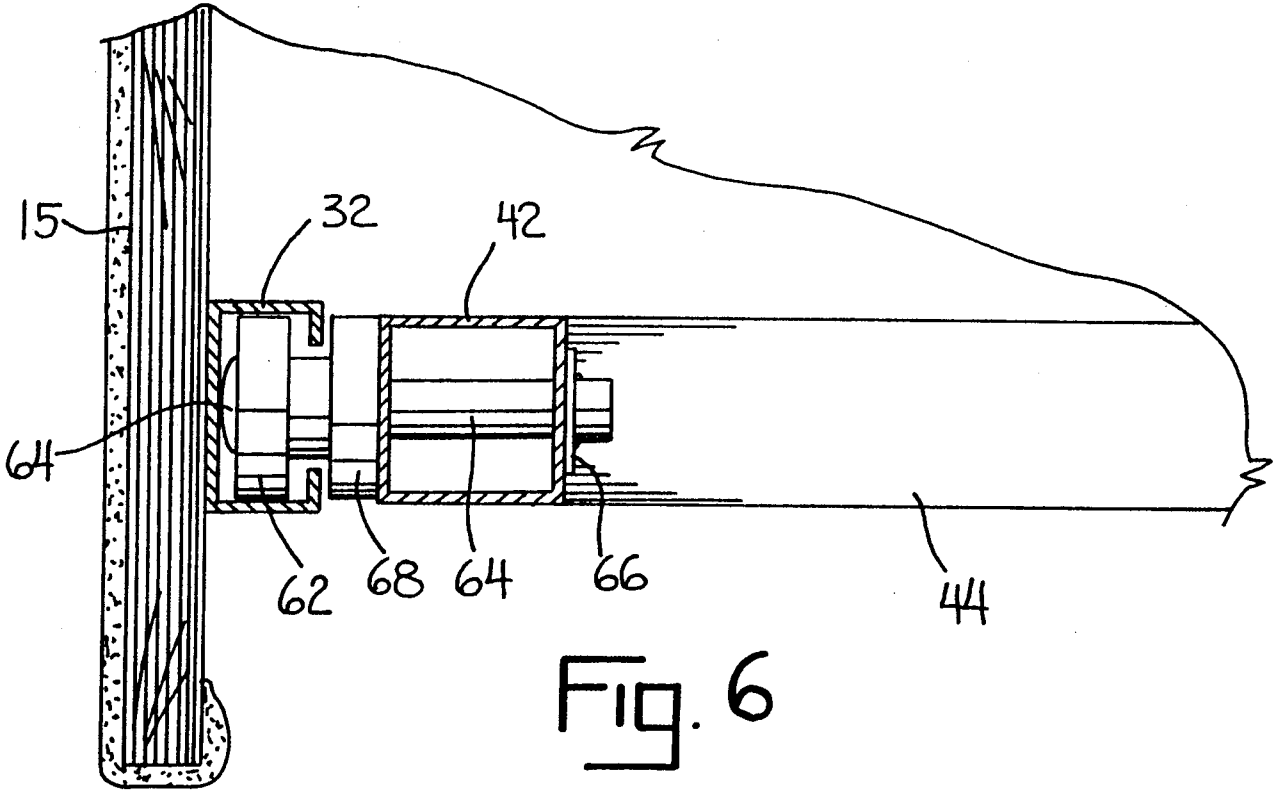
FIG. 6 is a fragmented cross-sectional view taken along line 6—6 of FIG. 5.

Frame support 12 defines a hollow interior chamber 28. Bed support 30 is shiftably connected to frame support 12 between a sofa position (FIGS. 1 and 4) and a bed position (FIGS. 2, 3 and 5). A guide channel rail 32 is connected to each front support 15 and back support 16.

Bed support 30 includes a lower bed support member 34 connected to a box-like upper bed support member 36 by links 38, 40. Lower bed support 34 includes side rails 42 and 43 and end rails 44 and 45 to form a generally rectangular frame. Upper bed support 36 is also generally rectangular and includes side rails 47 and 49, end rails 48 and 50, and cross rails 52. Vertical riser slats 54 space the top most bed support 56 from the bottom-most bed support 58 as shown to form a box-like configuration. A stepped table 60 is supported on topmost bed support 56 as shown.

Bed support 30 is supported for sliding movement by rollers 62. Each roller 62 is positioned in a guide channel rail 32 and is connected to side rail 42 or 43 as by rivet 64 and push nut 66. Spacer 68 insures proper spacing between guide channel 32 and rails 42, 43.

Each link 38 is connected at one end to lower bed support 34 as by pivot pin 70 and at its other end to upper bed support part 58 by pivot pin 72. Each link 40 is connected at one end to lower bed support 34 and to a stop link 74 by pivot pin 75, and is connected at its other end to upper bed support part 58 as by pivot pin 76.

Lower ed support 34 also includes mounting plates 78 (two shown) fastened to end rail 45. Rollers 80 are fastened to plates 78 to facilitate sliding movement of bed support 30 and to support the bed support in both its extended and retracted positions. Springs 82 (two shown) extend from cross rail 52 to mounting plates 78 as shown. Spacers 84 (four shown) are carried atop side rails 42, 43 to space upper bed support 36 above lower support 34 to prevent metal-to-metal contact during extension of the bed support.

Bed support 30 also includes a lock 86 which prevents the bed support from being accidentally shifted into the sofa position. Lock 86 includes a lever 88 connected to side rail 42 as by a bent bracket 90 and a pin (not shown). Lock 86 also includes flat plate 92 secured to an end of lever 88. A stop block 96 is fastened to guide channel rail 32 as shown.

The drawings illustrate the shifting of bed support 30 between the sofa position (FIGS. 1 and 4) and the bed position (FIGS. 2, 3 and 5). With the sofa-bed in the sofa position, a user grasps arm 18 and pulls the arm in the direction shown by arrow 98. Since upper bed support 36 is connected to arm 18, this action draws bed support 30 outwardly of chamber 28. Sliding movement of the bed support 30 is facilitated by rollers 62 and 80 is halted by rollers 62 contacting stops (not shown).

As the user continues to pull on arm 18, upper bed support 36 pivots about links 38, 40 upwardly and outwardly relative to lower bed support 34. When stop links 74 contact end rails 44, movement of upper bed support 36 ceases. This position is shown in FIG. 3. When upper bed support 36 is so raised, the weight of the support and stepped table 60 is lifted from lock lever 88. Flat plate 92 causes the end of lever 88 to drop into close proximity with stop block 96 to lock the bed support 30 in the bed position. Back cushions 24 may be removed and laid atop table 60 to define the bed as shown in FIG. 2.

When it is desired to shift bed support 30 back into the sofa position the user simply replaces cushions 24 and pushes in on arm 18 (see arrow 99). Upper bed support 36 pivots about links 38, 40 in the direction of arrows 100 (FIG. 5) inwardly and downwardly. As table 60 and lowermost support 58 contact lever 88, plate 92 is raised in the manner indicated by arrow 102 to clear stop block 96. As the user continues to push on arm 18 the arm contacts lower bed support 34 and urges the entire bed support back into chamber 28 until the arm contacts frame 12 to cease movement (FIG. 4).

The over-center pivoting action of links 38, 40 provides the raising action of bed support 30 necessary to forming a flat surface with seat cushions 22 once the bed support has been fully extended. Links 38, 40 and 74 in conjunction with springs 82 also provide stability for bed support 30 to ensure that accidental dropping of the bed support does not occur while the bed support is fully extended. Springs 82 also bias the bed support 36 toward the lowered position so that conversion into the sofa position is facilitated when arm 18 is pushed.

The above description does not limit the invention to the details above-given, but may be modified within the scope of the following claims.

We claim:

1. In a convertible sofa-bed including a support frame, said support frame including a seat support, a back support, and arm supports located along opposite sides of said seat support, the improvement comprising a bed support connected to one of said arm supports, means for shiftably connecting said bed support to one of said seat support and back support wherein said bed support is shiftable relative to said seat and back supports between a retracted sofa position beneath said seat support and an extended bed position extending laterally outwardly of said seat support said bed support further including a lower base frame slidably connected to one of said seat support and back support, and an upper frame, linkage means pivotally connecting said lower base frame to said upper frame, and means fixedly connecting said one arm support only to said upper frame such that movement of said one arm support actuates the pivoting of the upper frame outwardly with respect to said seat support.

2. The convertible sofa-bed of claim 1 wherein said linkage means includes a link, pivot means for pivotally connecting said link between said lower base frame and said upper frame whereby shifting of said bed support form said sofa position into said bed position raises said upper frame relative to said lower base frame.

3. The convertible sofa-bed of claim 2 wherein said link pivots across a vertical axis defined by said upper frame pivot means as the bed support is shifted into said bed position.

4. The convertible sofa-bed of claim 2 and biasing means connected between said upper frame and lower base frame for urging said upper frame laterally away from said seat support wherein shifting of said bed support into said sofa position is facilitated.

5. The convertible sofa-bed of claim 4 wherein said linkage means includes a stop link contacting said lower base frame to halt pivoting movement of said upper frame.

6. The convertible sofa-bed of claim 1 wherein said sofa-bed includes a seat cushion carried by said seat support, and a back cushion removably positioned against said back support, said back cushion positioned atop and supported by said bed support when in said bed position.

7. The convertible sofa-bed or claim 1 and further including roller means connected to said lower base frame for facilitating shifting of said bed support between said sofa position and said bed position.

8. The convertible sofa-bed of claim 1 and further including lock means for securing said bed support in said bed position.

9. The convertible sofa-bed of claim 1 wherein said support frame including opposed guide channel rails, said lower base frame including rollers attached thereto and extending into said guide channel rails to facilitate shifting of said bed support.

10. The convertible sofa-bed of claim 9 wherein said lock means includes a lever pivotally connected to said lower base frame, a stop block connected to one of said guide channel rails adjacent said lever, and means associated with said lever for pivoting the lever into contact with said stop block.

11. The convertible sofa-bed of claim 1 and a stepped table supported atop said upper frame, said table defining a support surface when the bed support is in said bed position.

12. The convertible sofa-bed of claim 1 and a spacer positioned on said lower base to space the base frame from said upper frame.

* * * * *